US010087058B1

(12) United States Patent
Carlson

(10) Patent No.: US 10,087,058 B1
(45) Date of Patent: Oct. 2, 2018

(54) JACK LIFT DEVICE

(71) Applicant: Jared Carlson, Denver, CO (US)

(72) Inventor: Jared Carlson, Denver, CO (US)

( * ) Notice: Subject to any disclaimer, the term of this patent is extended or adjusted under 35 U.S.C. 154(b) by 0 days.

(21) Appl. No.: 15/635,365

(22) Filed: Jun. 28, 2017

(51) Int. Cl.
*B66F 1/00* (2006.01)
*B66F 3/00* (2006.01)
*B66D 3/04* (2006.01)

(52) U.S. Cl.
CPC ..... *B66F 3/00* (2013.01); *B66D 3/04* (2013.01); *B66D 2700/026* (2013.01)

(58) Field of Classification Search
CPC ..... B66F 3/28; B66F 5/00; B66F 7/00; B66F 7/712
See application file for complete search history.

(56) References Cited

U.S. PATENT DOCUMENTS 1,731,324 A 10/1929 Bauer
2,046,516 A 7/1936 Johnson
2,483,239 A * 9/1949 Sharpe ..... B21D 3/10 254/93 R
4,598,795 A 7/1986 Larson
5,697,597 A * 12/1997 Goodbold ..... B60P 3/12 254/131
D506,858 S 6/2005 Kuehl et al.
7,350,770 B1 4/2008 Boyer
7,374,380 B2 * 5/2008 Huang ..... E04H 12/182 410/143
8,302,279 B1 * 11/2012 Hofer ..... B25B 27/14 254/30
8,820,713 B2 * 9/2014 Huang ..... B66F 3/02 254/100
8,960,645 B1 * 2/2015 Stewart ..... B64F 5/40 254/133 R
2005/0269156 A1 12/2005 Lanzafame
2013/0092889 A1 * 4/2013 Griffiths ..... B44C 5/02 254/133 R

FOREIGN PATENT DOCUMENTS

WO WO2007134043 11/2007

* cited by examiner

*Primary Examiner* — Lee D Wilson

(57) ABSTRACT

A jack lift device for lifting and positioning loads includes a tube, a pipe and a hoist. The tube is configured to insert into a hole in a top of a step ladder. The tube is configured to couple to the step ladder so that the tube is positioned substantially vertically. The pipe is complementary to and selectively slidably positionable within the tube. A plate is coupled to and extends perpendicularly from an upper end of the pipe. A hoist is coupled to the tube and operationally coupled to the pipe. The plate is configured to position a load, such as a metal conduit. The hoist is positioned to selectively compel the pipe vertically through the tube so that the load that is positioned on the plate is positioned at a desired height, such as proximate to a joist to which the metal conduit is to be is coupled.

14 Claims, 3 Drawing Sheets

JACK LIFT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to lift devices and more particularly pertains to a new lift device for lifting and positioning loads.

BRIEF SUMMARY OF THE INVENTION

An embodiment of the disclosure meets the needs presented above by generally comprising a tube, a pipe and a hoist. The tube is configured to insert into a hole in a top of a step ladder. The tube is configured to couple to the step ladder so that the tube is positioned substantially vertically. The pipe is complementary to and selectively slidably positionable within the tube. A plate is coupled to and extends perpendicularly from an upper end of the pipe. A hoist is coupled to the tube and operationally coupled to the pipe. The plate is configured to position a load, such as a metal conduit. The hoist is positioned to selectively compel the pipe vertically through the tube so that the load that is positioned on the plate is positioned at a desired height, such as proximate to a joist to which the metal conduit is to be is coupled.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
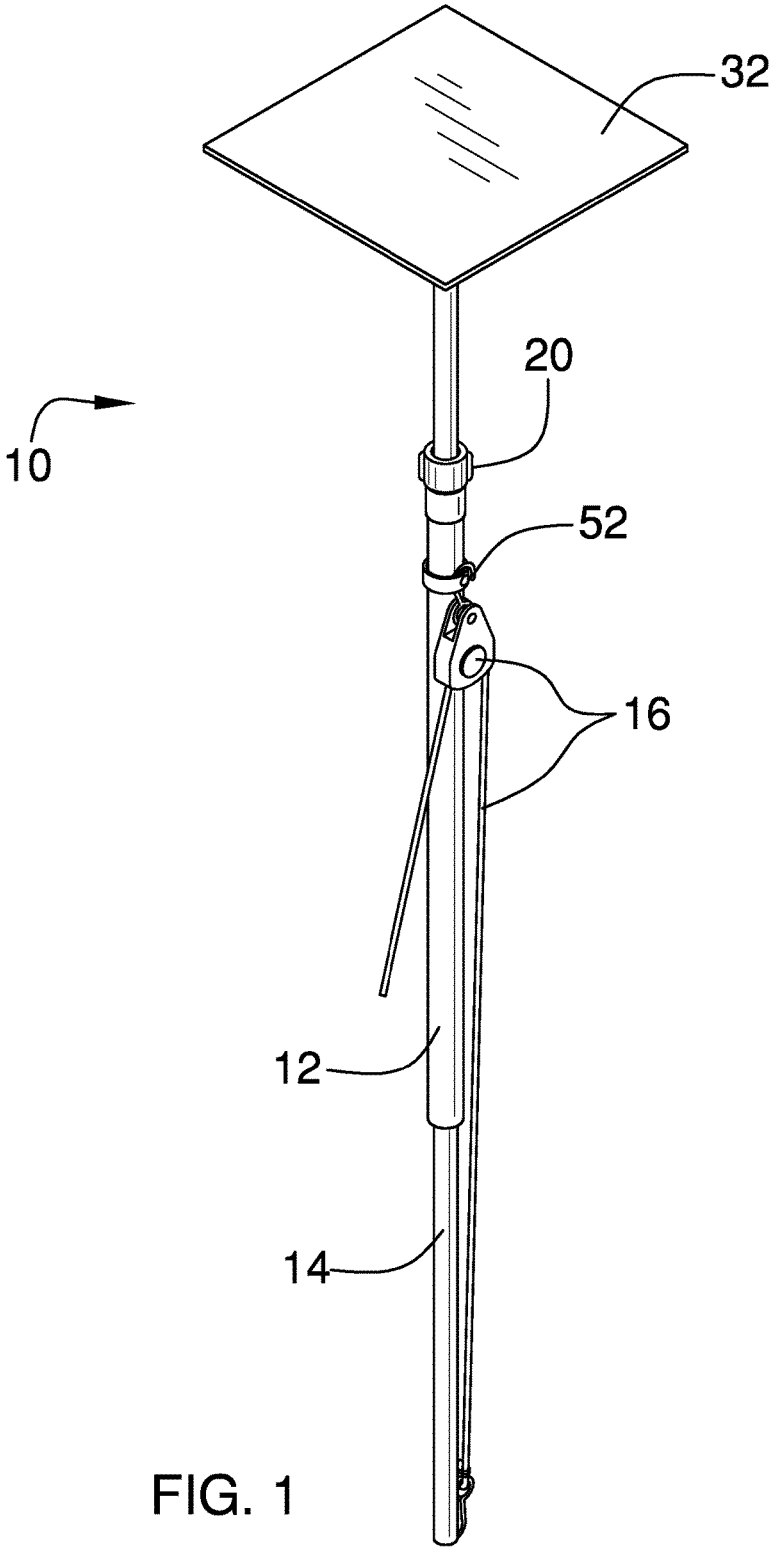
FIG. 1 is an isometric perspective view of a jack lift device according to an embodiment of the disclosure.
Figure 2:
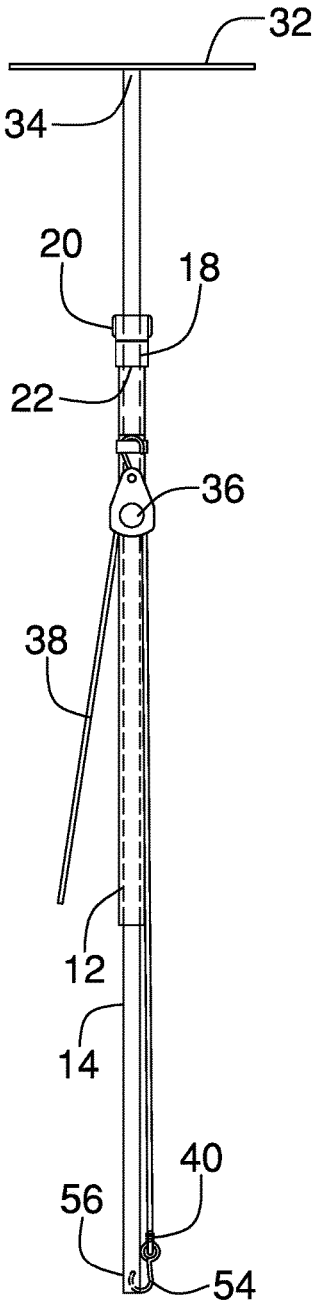
FIG. 2 is a side view of an embodiment of the disclosure.
Figure 3:
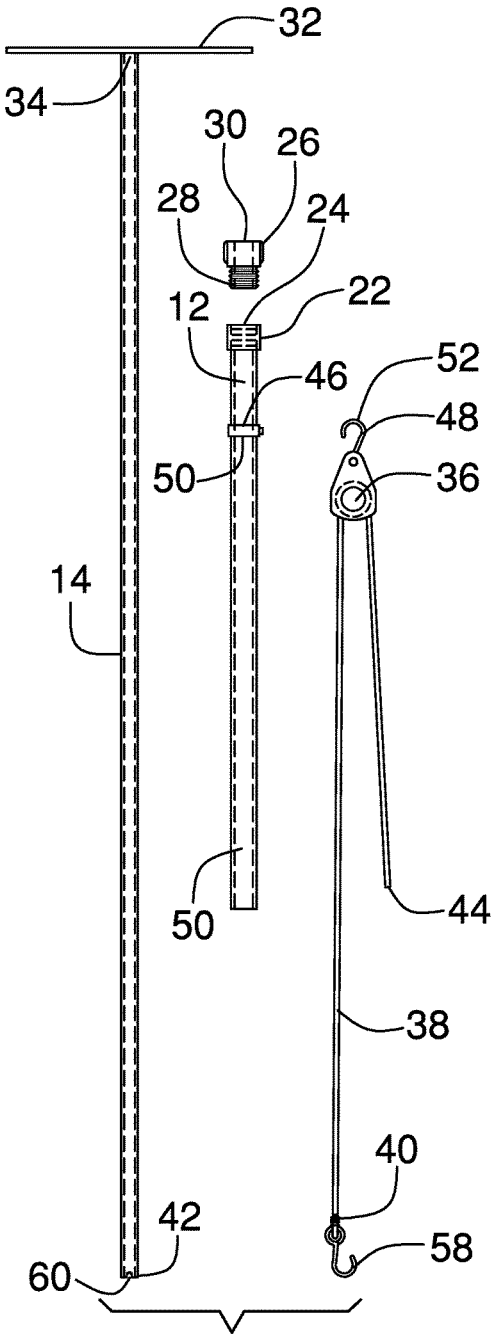
FIG. 3 is an exploded view of an embodiment of the disclosure.
Figure 4:
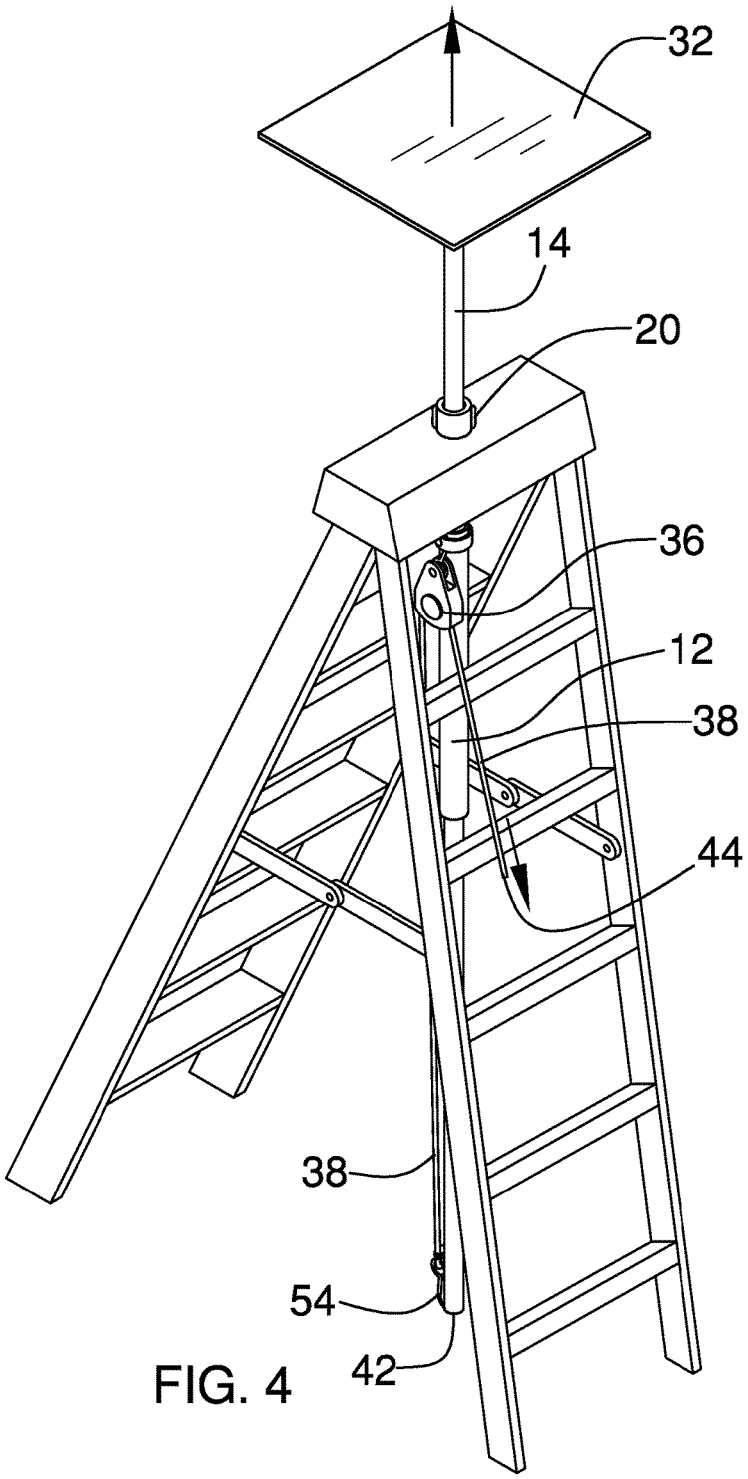
FIG. 4 is an in-use view of an embodiment of the disclosure.

With reference now to the drawings, and in particular to FIGS. 1 through 4 thereof, a new lift device embodying the principles and concepts of an embodiment of the disclosure and generally designated by the reference numeral 10 will be described.

As best illustrated in FIGS. 1 through 4, the jack lift device 10 generally comprises a tube 12, a pipe 14, and a hoist 16. The tube 12 is configured to be inserted into a hole in a top of a step ladder. The tube 12 also is configured to couple to the step ladder so that the tube 12 is positioned substantially perpendicular to a surface upon which the step ladder is positioned. In one embodiment, the tube 12 is circularly shaped when viewed longitudinally. In another embodiment, the tube 12 comprises polyvinylchloride.

In one embodiment, the device 10 comprises a first coupler 18 and a second coupler 20. The first coupler 18 is coupled to the tube 12 proximate to an upper endpoint 22 of the tube 12. The second coupler 20 is complementary to the first coupler 18. The first coupler 18 is configured to couple to the second coupler 20 to couple the tube 12 to the step ladder. In another embodiment, the first coupler 18 comprises internal threading 24 that is positioned in the tube 12 adjacent to the upper endpoint 22. The second coupler 20 comprises a sleeve 26 that has a first end 28 and a second end 30. The first end 28 is externally threaded. The tube 12 is positioned to threadedly insert the first end 28 of the sleeve 26 to couple the sleeve 26 to the tube 12. The second end 30 is dimensionally larger than the hole in the top of the step ladder. The second end 30 of the sleeve 26 is configured to abut the step ladder to prevent the tube 12 from sliding downwardly through the hole in the top of the step ladder.

The pipe 14 is complementary to and selectively slidably positionable within the tube 12. In one embodiment, the pipe 14 comprises metal. A plate 32 is coupled to an upper end 34 of the pipe 14. The plate 32 extends perpendicularly from the pipe 14. The plate 32 is configured to position a load, such as a metal conduit used in heating, ventilation, and air conditioning systems. In one embodiment, the pipe 14 is centrally positioned on the plate 32. In another embodiment, the plate 32 is rectangularly shaped. In yet another embodiment, the plate 32 is squarely shaped.

The hoist 16 is coupled to the tube 12 and operationally coupled to the pipe 14. The hoist 16 is positioned to selectively compel the pipe 14 vertically through the tube 12. The load that is positioned on the plate 32 is positioned at a desired height, such as proximate to a joist to which the metal conduit is to be is coupled. In one embodiment, the hoist 16 comprises a ratchet 36 and a rope 38. The ratchet 36 is coupled to the tube 12. The rope 38 has a first endpoint 40 that is coupled to a lower end 42 of the pipe 14. The rope 38 is operationally coupled to the ratchet 36 so that the rope 38 is configured to be grasped proximate to a second endpoint 44 and pulled to selectively compel the rope 38 through the ratchet 36 so that the pipe 14 is compelled vertically through the tube 12. The load that is positioned on the plate 32 is positioned at the desired height, such as proximate to the joist to which the metal conduit is to be attached.

In one embodiment, the device 10 comprises a first connector 46 and a second connector 48. The first connector 46 is coupled to the tube 12. The second connector 48 is coupled to the ratchet 36. The second connector 48 is complementary to the first connector 46. The second connector 48 is positioned to couple to the first connector 46 to couple the ratchet 36 to the tube 12. In another embodiment, the first connector 46 comprises a band 50 that is positioned around the tube 12 proximate to the upper endpoint 22. The second connector 48 comprises a first hook 52. The band 50 is positioned to insert the first hook 52 to couple the ratchet 36 to the tube 12.

In one embodiment, the device 10 comprises a first fastener 54 and a second fastener 56. The first fastener 54 is coupled to the first endpoint 40 of the rope 38. The second fastener 56 is coupled to the pipe 14. The second fastener 56 is complementary to the first fastener 54. The second fastener 56 is positioned to couple to the first fastener 54 to couple the rope 38 to the pipe 14. In another embodiment, the first fastener 54 comprises a second hook 58. The second fastener 56 comprises a notch 60 that extends into the pipe 14 from the lower end 42. The notch 60 is positioned to insert the second hook 58 to couple the rope 38 to the pipe 14.

In use, the internal threading 24 is positioned in the tube 12 so that the tube 12 is positioned to threadedly insert the first end 28 of the sleeve 26. The sleeve 26 is coupled to the tube 12. The second end 30 of the sleeve 26 is configured to abut the step ladder to prevent the tube 12 from sliding downwardly through the hole in the top of the step ladder. The notch 60 that is positioned in the pipe 14 is positioned to insert the second hook 58 to couple the rope 38 to the pipe 14. The band 50 that is positioned on the tube 12 is positioned to insert the first hook 52 to couple the ratchet 36 to the tube 12. The rope 38 is configured to be grasped proximate to the second endpoint 44 and pulled to selectively compel the rope 38 through the ratchet 36. The pipe 14 is compelled vertically through the tube 12. The load that is positioned on the plate 32, such as the metal conduit used in heating, ventilation, and air conditioning systems, is selectively positioned at the desired height, such as proximate to the joist to which the metal conduit is to be is coupled.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A jack lift device comprising:

a tube configured for inserting into a hole in a top of a step ladder, said tube being configured for coupling to the step ladder such that said tube is positioned substantially perpendicular to a surface upon which the step ladder is positioned;

a pipe complementary to and selectively slidably positionable within said tube;

a plate coupled to an upper end of said pipe, said plate extending perpendicularly from said pipe;

a hoist coupled to said tube, said hoist being operationally coupled to said pipe, said hoist comprising a ratchet and a rope, said ratchet being coupled to said tube, said rope having a first endpoint coupled to a lower end of said pipe, said rope being operationally coupled to said ratchet, wherein said rope is positioned in said ratchet such that said rope is configured for grasing proximate to a second endpoint of said rope and for pulling for selectively compelling said rope through said ratchet such that said pipe is compelled vertically through said tube such that the load positioned on said plate is positioned at the desired height, such as proximate to the joist to which the metal conduit is to be attached; and wherein said plate is positioned on said pipe such that said plate is configured for positioning a load, such as a metal conduit used in heating, ventilation, and air conditioning systems, wherein said hoist is positioned on said tube such that said hoist is positioned for selectively compelling said pipe vertically through said tube such that the load positioned on said plate is positioned at a desired height, such as proximate to a joist to which the metal conduit is to be coupled.

2. The device of claim 1, further including said tube being circularly shaped when viewed longitudinally.

3. The device of claim 1, further including said tube comprising polyvinylchloride.

4. The device of claim 2, further comprising:

a first coupler coupled to said tube proximate to an upper endpoint of said tube;

a second coupler complementary to said first coupler; and wherein said first coupler is positioned on said tube such that said first coupler is configured for coupling to said second coupler for coupling said tube to the step ladder.

5. A jack lift device comprising:

a tube configured for inserting into a hole in a top of a step ladder, said tube being configured for coupling to the step ladder such that said tube is positioned substantially perpendicular to a surface upon which the step ladder is positioned, said tube being circularly shaped when viewed longitudinally;

a pipe complementary to and selectively slidably positionable within said tube;

a plate coupled to an upper end of said pipe, said plate extending perpendicularly from said pipe;

a hoist coupled to said tube, said hoist being operationally coupled to said pipe;

wherein said plate is positioned on said pipe such that said plate is configured for positioning a load, such as a metal conduit used in heating, ventilation, and air conditioning systems, wherein said hoist is positioned on said tube such that said hoist is positioned for selectively compelling said pipe vertically through said tube such that the load positioned on said plate is positioned at a desired height, such as proximate to a joist to which the metal conduit is to be coupled;

a first coupler coupled to said tube proximate to an upper endpoint of said tube;

a second coupler complementary to said first coupler; and wherein said first coupler is positioned on said tube such that said first coupler is configured for coupling to said second coupler for coupling said tube to the step ladder;

said first coupler comprising internal threading positioned in said tube adjacent to said upper endpoint;

said second coupler comprising a sleeve having a first end and a second end, said first end being externally threaded, said second end being dimensionally larger than the hole in the top of the step ladder; and wherein said internal threading is positioned in said tube such that said tube is positioned for threadedly inserting said first end of said sleeve for coupling said sleeve to said tube, wherein said sleeve is positioned on said tube such that said second end of said sleeve is configured for abutting the step ladder for preventing said tube from sliding downwardly through the hole in the top of the step ladder.

6. The device of claim 1, further including said pipe comprising metal.

7. The device of claim 1, further including said pipe being centrally positioned on said plate.

8. The device of claim 1, further including said plate being rectangularly shaped.

9. The device of claim 8, further including said plate being squarely shaped.

10. A jack lift device comprising:

a tube configured for inserting into a hole in a top of a step ladder, said tube being configured for coupling to the step ladder such that said tube is positioned substantially perpendicular to a surface upon which the step ladder is positioned;

a pipe complementary to and selectively slidably positionable within said tube;

a plate coupled to an upper end of said pipe, said plate extending perpendicularly from said pipe, said plate being squarely shaped;

a hoist coupled to said tube, said hoist being operationally coupled to said pipe;

wherein said plate is positioned on said pipe such that said plate is configured for positioning a load, such as a metal conduit used in heating, ventilation, and air conditioning systems, wherein said hoist is positioned on said tube such that said hoist is positioned for selectively compelling said pipe vertically through said tube such that the load positioned on said plate is positioned at a desired height, such as proximate to a joist to which the metal conduit is to be coupled;

a first connector coupled to said tube;

a second connector coupled to said ratchet, said second connector being complementary to said first connector; and wherein said second connector is positioned on said ratchet such that said second connector is positioned for coupling to said first connector for coupling said ratchet to said tube.

11. The device of claim 10, further comprising:

said first connector comprising a band positioned around said tube proximate to said upper endpoint;

said second connector comprising a first hook; and wherein said band is positioned on said tube such that said band is positioned for inserting said first hook for coupling said ratchet to said tube.

12. A jack lift device comprising:

a tube configured for inserting into a hole in a top of a step ladder, said tube being configured for coupling to the step ladder such that said tube is positioned substantially perpendicular to a surface upon which the step ladder is positioned;

a pipe complementary to and selectively slidably positionable within said tube;

a plate coupled to an upper end of said pipe, said plate extending perpendicularly from said pipe, said plate being squarely shaped;

a hoist coupled to said tube, said hoist being operationally coupled to said pipe;

wherein said plate is positioned on said pipe such that said plate is configured for positioning a load, such as a metal conduit used in heating, ventilation, and air conditioning systems, wherein said hoist is positioned on said tube such that said hoist is positioned for selectively compelling said pipe vertically through said tube such that the load positioned on said plate is positioned at a desired height, such as proximate to a joist to which the metal conduit is to be coupled;

a first fastener coupled to said first endpoint of said rope;

a second fastener coupled to said pipe, said second fastener being complementary to said first fastener, wherein said second fastener is positioned on said pipe such that said second fastener is positioned for coupling to said first fastener for coupling said rope to said pipe.

13. The device of claim 12, further comprising:

said first fastener comprising a second hook;

said second fastener comprising a notch extending into said pipe from said lower end; and wherein said notch is positioned in said pipe such that said notch is positioned for inserting said second hook for coupling said rope to said pipe.

14. A jack lift device comprising:

a tube configured for inserting into a hole in a top of a step ladder, said tube being configured for coupling to the step ladder such that said tube is positioned substantially perpendicular to a surface upon which the step ladder is positioned, said tube being circularly shaped when viewed longitudinally, said tube comprising polyvinylchloride, a first coupler coupled to said tube proximate to an upper endpoint of said tube, said first coupler comprising internal threading positioned in said tube adjacent to said upper endpoint;

a second coupler complementary to said first coupler, wherein said first coupler is positioned on said tube such that said first coupler is configured for coupling to said second coupler for coupling said tube to the step ladder, said second coupler comprising a sleeve having a first end and a second end, said first end being externally threaded, wherein said internal threading is positioned in said tube such that said tube is positioned for threadedly inserting said first end of said sleeve for coupling said sleeve to said tube, said second end being dimensionally larger than the hole in the top of the step ladder, wherein said sleeve is positioned on said tube such that said second end of said sleeve is configured for abutting the step ladder for preventing said tube from sliding downwardly through the hole in the top of the step ladder;

a pipe complementary to and selectively slidably positionable within said tube, said pipe comprising metal;

a plate coupled to an upper end of said pipe, said plate extending perpendicularly from said pipe, wherein said plate is positioned on said pipe such that said plate is configured for positioning a load, such as a metal conduit used in heating, ventilation, and air conditioning systems, said pipe being centrally positioned on said plate, said plate being rectangularly shaped, said plate being squarely shaped;

a hoist coupled to said tube, said hoist being operationally coupled to said pipe, wherein said hoist is positioned on said tube such that said hoist is positioned for selectively compelling said pipe vertically through said tube such that the load positioned on said plate is positioned at a desired height, such as proximate to a joist to which the metal conduit is to be coupled, said hoist comprising a ratchet and a rope, said ratchet being coupled to said tube, said rope having a first endpoint coupled to a lower end of said pipe, said rope being operationally coupled to said ratchet, wherein said rope is positioned in said ratchet such that said rope is configured for grasping proximate to a second endpoint of said rope and for pulling for selectively compelling said rope through said ratchet such that said pipe is compelled vertically through said tube such that the load positioned on said plate is positioned at the desired height, such as proximate to the joist to which the metal conduit is to be attached;

a first connector coupled to said tube, said first connector comprising a band positioned around said tube proximate to said upper endpoint;

a second connector coupled to said ratchet, said second connector being complementary to said first connector, wherein said second connector is positioned on said ratchet such that said second connector is positioned for coupling to said first connector for coupling said ratchet to said tube, said second connector comprising a first hook, wherein said band is positioned on said tube such that said band is positioned for inserting said first hook for coupling said ratchet to said tube;

a first fastener coupled to said first endpoint of said rope, said first fastener comprising a second hook;

a second fastener coupled to said pipe, said second fastener being complementary to said first fastener, wherein said second fastener is positioned on said pipe such that said second fastener is positioned for coupling to said first fastener for coupling said rope to said pipe, said second fastener comprising a notch extending into said pipe from said lower end, wherein said notch is positioned in said pipe such that said notch is positioned for inserting said second hook for coupling said rope to said pipe; and wherein said internal threading is positioned in said tube such that said tube is positioned for threadedly inserting said first end of said sleeve for coupling said sleeve to said tube, wherein said sleeve is positioned on said tube such that said second end of said sleeve is configured for abutting the step ladder for preventing said tube from sliding downwardly through the hole in the top of the step ladder, wherein said notch is positioned in said pipe such that said notch is positioned for inserting said second hook for coupling said rope to said pipe, wherein said band is positioned on said tube such that said band is positioned for inserting said first hook for coupling said ratchet to said tube, wherein said rope is positioned in said ratchet such that said rope is configured for grasping proximate to said second endpoint of said rope and for pulling for selectively compelling said rope through said ratchet such that said pipe is compelled vertically through said tube such that the load positioned on said plate, such as the metal conduit used in heating, ventilation, and air conditioning systems, is selectively positioned at the desired height, such as proximate to the joist to which the metal conduit is to be attached.

* * * * *